United States Patent [19]

Grote

[11] Patent Number: 4,972,519

[45] Date of Patent: Nov. 20, 1990

[54] VERTICAL COMA CORRECTION ARRANGEMENT

[75] Inventor: Michael D. Grote, Mercerville, N.J.

[73] Assignee: RCA Licensing Corporation, Princeton, N.J.

[21] Appl. No.: 394,692

[22] Filed: Aug. 16, 1989

[51] Int. Cl.[5] ..... H01J 29/76; H01F 3/12

[52] U.S. Cl. ..... 313/440; 335/211

[58] Field of Search ..... 313/412, 440; 315/368, 315/370; 335/211, 212, 213, 214, 210

[56] References Cited

U.S. PATENT DOCUMENTS

| | | | |
|---|---|---|---|
| 4,305,055 | 12/1981 | Marett, Jr. | 335/211 |
| 4,307,363 | 12/1981 | McGlashan | 335/211 |
| 4,335,366 | 6/1982 | Alig et al. | 335/211 |
| 4,357,556 | 11/1982 | Burke | 313/440 |
| 4,357,586 | 11/1982 | Barkow et al. | 335/211 |
| 4,547,707 | 10/1985 | Yabase | 315/368 |
| 4,725,763 | 2/1988 | Okuyama et al. | 315/368 |
| 4,728,915 | 3/1988 | Konosu et al. | 335/211 |

FOREIGN PATENT DOCUMENTS 2013972A 8/1979 United Kingdom .

OTHER PUBLICATIONS

"43 in. Direct-View Color CRT", A. Ashizaki, et al., presented at the 1988 SID Conference, May 24–26, 1988 and published in the Proceedings, SID, vol. 29/1, 12/1988.

*Primary Examiner*—Kenneth Wieder

*Attorney, Agent, or Firm*—Joseph S. Tripoli; Joseph J. Laks; Sammy S. Henig

[57] ABSTRACT

An assembly that includes four separate tabs is used for producing from a stray magnetic field flux, a pincushion shaped field in a portion of the neck of a cathode ray tube that is located at the rear of a deflection yoke for providing vertical convergence coma correction. Coils that are wound around the tabs form a quadrupole electromagnet that also provides dynamic convergence correction.

14 Claims, 3 Drawing Sheets

VERTICAL COMA CORRECTION ARRANGEMENT

The invention relates to a deflection yoke corrector that provides raster coma error correction.

In deflection yokes for cathode ray tubes (CRT) having three horizontal in-line electron beams R, G and B, the red, green and blue beams are required to substantially converge on the CRT display screen. A deflection yoke which does not require dynamic convergence circuitry is referred to as a self-converging yoke. That which requires dynamic convergence circuitry is referred to as a non-self-converging yoke. A self-converging yoke is constructed so that the horizontal deflection coil generates an overall pincushion type deflection magnetic field and the vertical deflection coil generates an overall barrel type deflection magnetic field. A non-self-converging yoke is used for improving, for example, beam focus, trilemma, raster distortion and vertical convergence coma (vcoma).

Vcoma occurs because of a nonuniformity of the vertical deflection field. For example, when the barrel type vertical deflection magnetic field is utilized, the strength of the magnetic field through which the green beam is deflected may be weaker than that through which each of the blue and red beams is deflected. The result is a misconvergence in the vertical direction of the center green beam with respect to the outer red and blue beams. This type of misconvergence is known as vcoma.

An example of a vcoma correction arrangement is described in U.S. Pat. No. 4,357,556, entitled TELEVISION DISPLAY SYSTEM EMPLOYING PERMEABLE CORRECTORS FOR A DEFLECTION YOKE, in the name of Burke. There, a correction apparatus for a deflection yoke for use with a color television kinescope includes a plurality of magnetically permeable rods disposed at the rear of the yoke. Each of the rods comprises a short portion disposed parallel to the neck of the kinescope and an elongated portion disposed perpendicular to the neck of the kinescope. The elongated portions of the rods are positioned within the external field of the vertical deflection coils. Flux from the external field is channeled into the rods to form a magnetic field between the short portions of corresponding members on opposite sides of the tube neck to provide vertical coma correction.

Another example of a vcoma correction arrangement is described in U.S. Pat. No. 4,357,586, entitled COLOR TV DISPLAY SYSTEM, in the names of Barkow et al., (the Barkow et al., patent) in which an external stray flux is collected from a vertical deflection coil. That flux is channelled by a pair of field formers to the rear of the yoke. That flux forms a localized pincushion-shaped field in the path of the three beams for correcting coma errors that are introduced by the deflection field of the deflection coil. Each of the field formers is made of a magnetic permeable material and has a U-shaped form that includes a pair of parallel arms and a cross arm connecting them. Disadvantageously, the cross arm might affect North/South pincushion distortion and the stored energy at the horizontal frequency.

In accordance with an aspect of the invention, a coma tab assembly includes more than two permeable metal tabs such as, for example, four, that are located at the rear or entrance of the deflection yoke and that are magnetically separated from one another. The four metal tabs are formed by plates that redirect the external stray vertical magnetic field toward the entrance of the deflection yoke for correcting convergence of the three electron beams such as, for example, vcoma. Each plate is mechanically rigid and, therefore, advantageously, can withstand inadvertent mechanical contact without being deformed. The plate is also easy to produce and can be mechanically easily attached to the CRT.

The tabs cause, for example, an increase in the vertical magnetic field in the vicinity of the green beam relative to that in the vicinity of each of the blue and red beams. Consequently, the deflection of the green beam is increased relative to that of the red and blue beams. In this way, vcoma, for example, is corrected.

A type of horizontal misconvergence that may require dynamic convergence is shown in FIG. 4. As shown in FIG. 4, when a vertical line that is formed by the three beams is displayed, a misconvergence $Y_H$ in the horizontal direction occurs between the vertical lines, produced by the red and blue beams, at the upper and lower end parts in the Y axis direction of the screen of the CRT.

U.S. Pat. No. 4,547,707 entitled DEFLECTION YOKE APPARATUS in the name of Yabase (the Yabase patent) describes a dynamic convergence arrangement. In the Yabase patent, a rectified current having a parabolic waveform is coupled to a pair of correction coils. The correction coils are wound around U-shaped magnetic cores. The magnetic cores form a magnetic quadrupole that provides dynamic convergence.

In accordance with another aspect of the invention, correction coils are wound around, for example, four tabs that are used for vcoma correction. Thus, advantageously, the four tabs provide both vcoma correction and dynamic convergence.

In a television display apparatus embodying an aspect of the invention, a cathode ray tube is used for producing three in-line electron beams that travel through a neck of said cathode ray tube. A deflection yoke includes a horizontal deflection winding, a vertical deflection winding and a magnetically permeable core encircling a longitudinal axis of the neck. The deflection yoke has a beam entrance region and a beam exit region. The deflection yoke produces a main magnetic flux inside the neck of the cathode ray tube that deflects the electron beams. A magnetically permeable assembly of a plurality of magnetically permeable field formers disposed around the neck in the vicinity of said beam entrance region. The magnetically permeable assembly is used for collecting a stray magnetic field flux produced by the deflection yoke and for producing from the collected flux a first correction magnetic field inside the neck, in the beam entrance region between corresponding ones of the field formers that corrects a first electron beam landing error. A correction coil arrangement magnetically coupled to the magnetically permeable assembly and responsive to a deflection synchronized current produces a second correction magnetic field inside one neck, in the beam entrance region between corresponding ones of the field formers region that dynamically corrects a second electron beam landing error.

Figure 1:
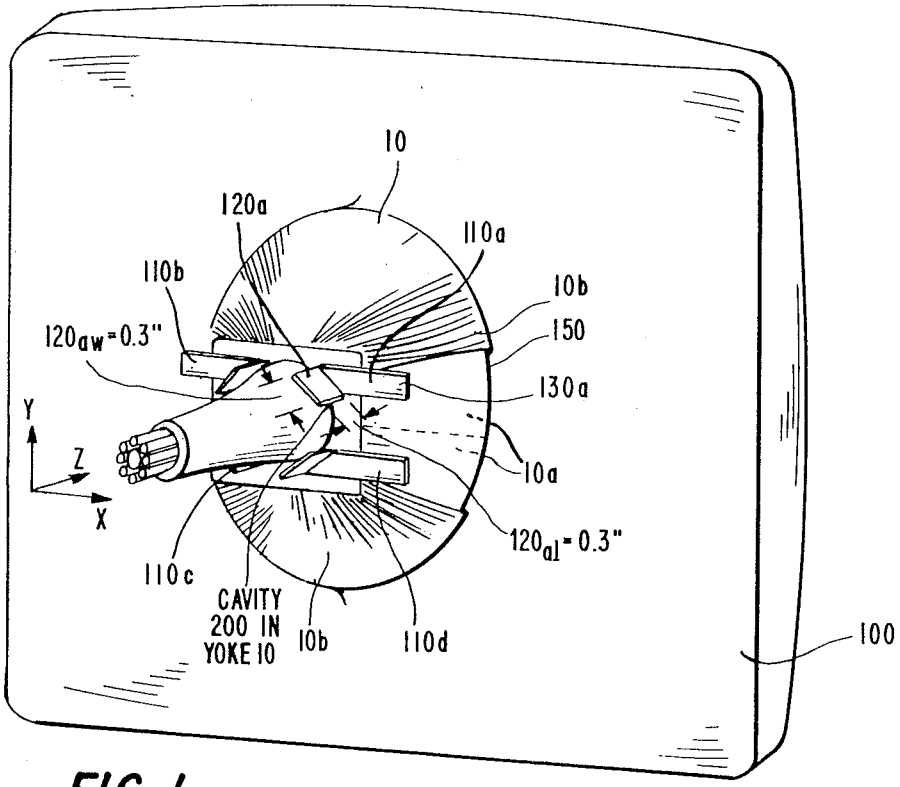
FIG. 1 illustrates a rear view of a deflection yoke that includes a coma tab assembly, embodying an aspect of the invention, that is mounted on a neck of a CRT.

FIG. 1 illustrates a rear view of a deflection yoke 10 that includes a coma tab assembly 110, embodying an aspect of the invention. Yoke 10 is mounted on a neck of a CRT 100 that is received in a cavity 200 in yoke 10. CRT 100 includes three horizontal in-line electron beam guns that produce three electron beams R, G and B. Yoke 10 includes, for example, a saddle coil 10*a* that provides horizontal deflection and, for example, a toroidal coil 10*b* that provides vertical deflection. Toroidal coil 10*b* is wound on a core 150 having an internal surface of revolution that surrounds the neck of CRT 100 and an external surface of revolution on which a portion of coil 10*b*, that is visible in FIG. 1, is wound. Core 150 also surrounds coil 10*a*. Coil 10*b* produces an overall barrel-shaped main magnetic field flux in the neck portion of CRT 100.

A longitudinal axis Z of CRT 100, shown in FIG. 1, indicates a direction that is perpendicular to a display screen of CRT 100. An axis X indicates a horizontal deflection direction and an axis v indicates a vertical deflection direction.

Figure 2:
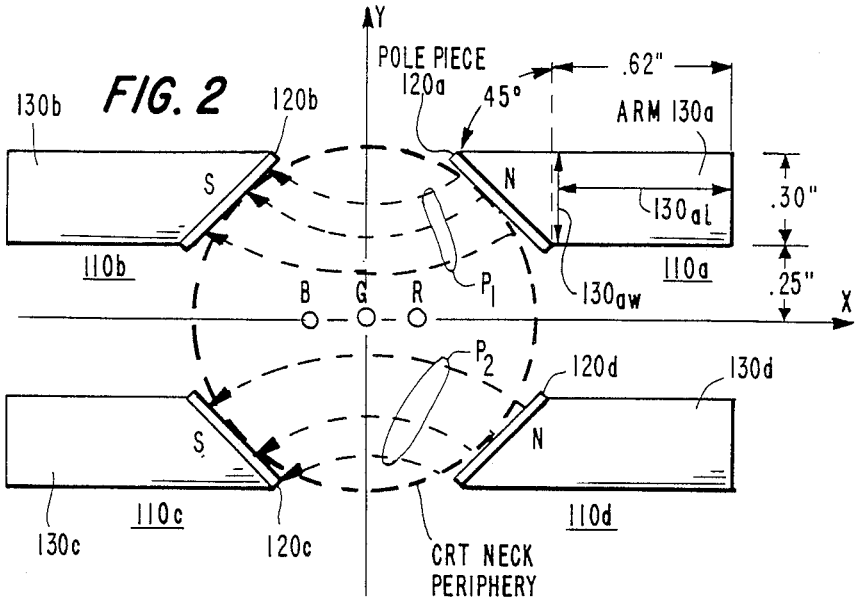
FIG. 2 illustrates the tab assembly of FIG. 1 without showing the deflection yoke.

FIG. 2 illustrates a view of tab assembly 110 when it is removed from yoke 10 of FIG. 1. Tab assembly 110 of FIG. 2 is shown, by itself, as it is seen from the rear side of CRT 100 of FIG. 1 when yoke 10 is mounted on CRT 100. For simplification purposes, the other parts of deflection yoke 10 are not shown in FIG. 2. Similar symbols and numerals in FIGS. 1 and 2 indicate similar items or functions.

Coma tab assembly 110 of FIG. 1 includes four magnetically separated field formers or tabs 110*a*, 110*b*, 110*c* and 110*d*. Each of the tabs is made of a magnetically permeable strip or plate of metal such as silicon steel having a thickness of, for example 0.01 inch. Each plate is bent to form an angle. Each bent plate that forms the corresponding tab includes a pole piece and an arm piece that are, for example, perpendicular.

Tab 110*a*, for example, includes a pole piece 120*a* and an arm piece 130*a* that are disclosed in perpendicular planes. Pole piece 120*a* extends, in the direction of its length dimension $\mathbf{120}_{al}$, in the direction of axis Z; whereas, arm piece 130*a* of FIG. 2 extends, in the direction of its length dimension $\mathbf{130}_{al}$, in the direction of axis X. Length dimension $\mathbf{130}_{al}$ and a width dimension $\mathbf{130}_{aw}$ of arm piece 130*a* are located in the X-Y plane defined by axes X and Y. Whereas, length dimension $\mathbf{120}_{al}$, and a width dimension $\mathbf{120}_{aw}$ of pole piece 120*a* of FIG. 1 are located in a plane that is perpendicular to the X-Y plane and that is inclined by approximately 45° relative to each of the X-Z and Y-Z planes, as shown in FIG. 2.

Tabs 110*a* and 110*b* are disposed symmetrically relative to axis Y. Tabs 110*c* and 110*d* are also disposed symmetrically relative to axis Y. Tabs 110*a* and 110*d* are disposed symmetrically relative to axis X. Tabs 110*b* and 110*c* are also disposed symmetrically relative to axis X.

In operation, each of arm pieces 130*a*–130*d* that are disposed outside yoke 10 collects the external stray magnetic flux generated by vertical deflection coil 10*b* of yoke 10. Arm pieces 130*a*–130*d* channel the corresponding collected stray magnetic flux to the rear of yoke 10 via corresponding pole pieces 120*a*–120*d*. Without the external flux channeling operation of arm pieces 130*a*–130*d*, the stray magnetic field flux would have formed a closed loop magnetic path that does not include the neck portion of CRT 100. The stray magnetic field flux is produced outside deflection yoke 10 in such a way that core 150 separates the stray magnetic field flux from cavity 200 formed by deflection yoke 10 through which the neck portion of CRT 100 is received. The length $\mathbf{130}_{al}$ of arm 130*a*, for example, is determined by taking into consideration the amount of flux that is required to be collected to achieve the required vcoma correction.

Each of pole pieces 120*a*–120*d* is disposed in the vicinity of the electron beam entrance region of yoke 10. Consequently, a pincushion-shaped magnetic field is produced that includes a magnetic field portion $P_1$, between pole pieces 120*a* and 120*b*, and a magnetic field portion $P_2$, between pole pieces 120*d* and 120*c*. Field portions $P_1$ and $P_2$ that are shown in dashed lines are produced within the neck of CRT 100.

The pincushion field provides a field nonuniformity suitable for electron beam error correction such as vcoma correction since the vertical component of each of field portions $P_1$ and $P_2$ is stronger in the vicinity of electron beam G than in the vicinity of each of electron beams R and B. The pincushion field is desirably located at the vcoma sensitive electron beam entrance region of deflection yoke 10, as explained in detail in the Barkow et al., patent that is incorporated by reference herein.

In accordance with a feature of the invention, each of the four tabs that channels the stray magnetic field flux to the entrance portion of yoke 10 is magnetically separated from each of the other ones. Thus, none of four tabs 110*a*–110*d* is connected to any of the other tabs by a magnetically permeable material. By being so magnetically separated, the tabs do not appreciably disturb, for example, North/South pin correction and the energy stored in yoke 10 at the horizontal rate. Thus, such parameters of yoke 10, advantageously, remain unaffected. In this way, the design of yoke 10 can be optimized for obtaining the required yoke parameters without being compromised by effects of tab assembly 110.

The width of each plate that forms the corresponding one of pole pieces 120*a*–120*d* and arm pieces 130*a*–130*d* is substantially larger than its thickness. Such relative dimensions facilitate producing the required pincushion-shaped magnetic field. Such relative dimensions also make tabs 110*a*–110*d* easier to attach to CRT 100 and provide mechanical rigidity. Because of the mechanical rigidity of the plates that form tabs 110*a*–110*d*, tabs 110*a*–110*d* can withstand vibrations and inadvertently applied forces that would have otherwise caused deformation in tabs 110*a*–110*b*.

Figure 3:
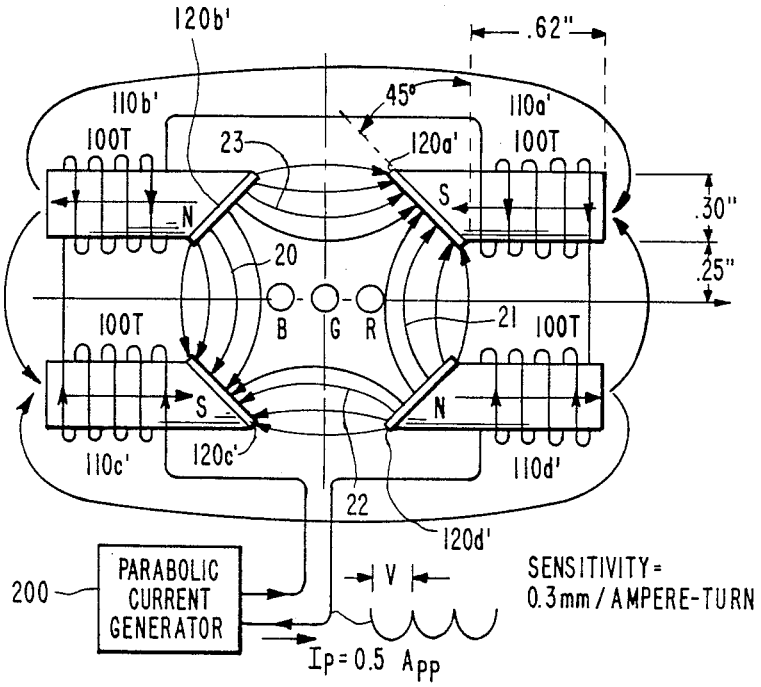
FIG. 3 illustrates a tab assembly, embodying another aspect of the invention, that can also provide dynamic convergence.

FIG. 3 illustrates a view of a tab assembly 110′, embodying another aspect of the invention. The arrangement of FIG. 3 is similar to that of FIG. 2 except for the addition of coil windings 140*a*, 140*b*, 140*c* and 140*d* that are wound on arm pieces 130*a*′, 130*b*′, 130*c*′ and 130*d*′, respectively. A numeral or symbol that is identical or that differs in FIG. 3 from that in FIG. 2 only by the prime symbol (′) indicates a similar item or function in both FIGS. 2 and 3.

Coil windings 140*a*–140*d* are coupled in series and driven by a source 200 of a deflection synchronized, current $I_p$ that is, for example, parabolic at a vertical rate and that provides dynamic convergence. The design of current source 200 is conventional and well-known in the art.

Figure 4:
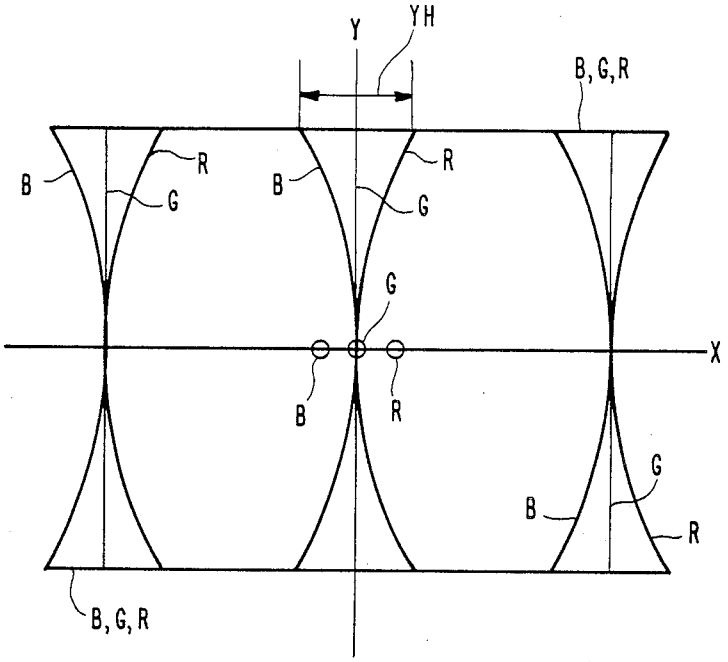
FIG. 4 illustrates the type of misconvergence that is corrected by the arrangement of FIG. 3.

FIG. 4 illustrates the effect of an electron beam landing error such as a horizontal misconvergence that can be eliminated by the arrangement of FIG. 3. As shown in FIG. 3, a correction magnetic flux 20 generated from magnetic pole piece **120*b* converges in the horizontal direction the red electron beam R onto the green electron beam G. Similarly, a magnetic flux 21 from magnetic pole piece 120*a* converges the blue electron beam B onto the green electron beam G. Magnetic fluxes 22 and 23** do not appreciably affect the convergence in the horizontal direction of the electron beams.

The misconvergence $Y_H$ of FIG. 4 becomes larger toward the upper and lower sides of the screen. Therefore, the magnitude of parabolic current $I_p$ of FIG. 3 is made larger at the beginning and at the end of vertical trace than at the center. Correction current $I_p$ becomes approximately zero at the center of vertical trace. Thus, the misconvergence $Y_H$ of FIG. 4 is corrected over the full range of the screen to obtain a satisfactory convergence. Advantageously, tabs **110*a*'–110*d*'** provide both vcoma correction and dynamic convergence.

What is claimed is:

1. A television display apparatus, comprising:

a cathode ray tube for producing three in-line electron beams that travel through a neck of said cathode ray tube;

a deflection yoke including a horizontal deflection winding, a vertical deflection winding and a magnetically permeable core encircling a longitudinal axis of said neck, and having a beam entrance region and a beam exit region, said deflection yoke producing a main magnetic flux inside said neck of said cathode ray tube that deflects said electron beams;

a magnetically permeable assembly of a plurality of magnetically permeable field formers disposed around said neck in the vicinity of said beam entrance region for collecting a stray magnetic field flux produced by said deflection yoke and for producing from said collected flux a first correction magnetic field inside said neck, in said beam entrance region between corresponding ones of said field formers, that corrects a first electron beam landing error; and a correction coil arrangement magnetically coupled to said magnetically permeable assembly and responsive to a deflection synchronized current for producing a second correction magnetic field inside said neck, in said beam entrance region between corresponding ones of said field formers, that dynamically corrects a second electron beam landing error.

2. An apparatus according to claim 1 wherein at least one of said field formers includes a pole piece that form a plate having a longitudinal axis that is in a direction perpendicular to a display screen of said cathode ray tube and an arm piece forming a corresponding plate that has a longitudinal axis forming an angle with said longitudinal axis of said pole piece.

3. An apparatus according to claim 2 wherein said longitudinal axes are substantially perpendicular.

4. An apparatus according to claim 1 wherein said field formers correct a vertical coma convergence error and provide dynamic convergence in a horizontal direction.

5. An apparatus according to claim 1 wherein said plurality of field formers includes four of such field formers that form four magnetic field poles.

6. An apparatus according to claim 1 wherein each of said field formers is magnetically separated from each of the other field formers.

7. An apparatus according to claim 6 wherein said plurality of field formers includes more than two field formers.

8. An apparatus according to claim 1 wherein said correction coil is wound on said field formers.

9. An apparatus according to claim 1 wherein said magnetically permeable field formers direct said collected stray magnetic flux to said beam entrance region for producing a pincushion-shaped magnetic field that provides vertical coma convergence correction.

10. An apparatus according to claim 1 wherein, without the operation of said field formers, said stray magnetic field flux that is collected would have formed a closed-loop path that is entirely outside said neck of said cathode ray tube.

11. An apparatus according to claim 1 wherein said deflection synchronized current comprises a vertical rate parabolic current.

12. A television display apparatus, comprising:

a cathode ray tube for producing three in-line electron beams that travel through a neck portion of said cathode ray tube;

a deflection yoke including a horizontal deflection winding, a vertical deflection winding and a magnetically permeable core, forming an inner cavity that receives said neck portion of said cathode ray tube and having a beam entrance region and a beam exit region, for producing a main magnetic flux in said neck portion of said cathode ray tube that deflects said electron beams; and a plurality, greater than two, of magnetically permeable field formers disposed around said neck portion in the vicinity of said beam entrance region, each one being magnetically separated from the other ones, for collecting a stray magnetic field flux produced by said deflection yoke outside both said deflection yoke and said inner cavity to produce from said collected flux a magnetic field in said beam entrance region that provides convergence error correction, a given one of said field formers comprising a plate having a width dimension that is substantially larger than its corresponding thickness dimension.

13. A television display apparatus, comprising:

a cathode ray tube for producing three in-line electron beams that travel through a neck portion of said cathode ray tube;

a deflection yoke including a horizontal deflection winding, a vertical deflection winding and a magnetically permeable core, encircling a longitudinal axis of said neck portion and having a beam entrance region and a beam exit region, for producing a main magnetic flux in said neck portion of said cathode ray tube that deflects said electron beams; and a plurality, greater than two, of magnetically permeable field formers disposed around said neck portion in the vicinity of said beam entrance region, each one being magnetically separated from the other ones and each comprising a plate having a width dimension that is substantially larger than its corresponding thickness dimension, for collecting a stray magnetic field flux produced by said deflection yoke and for producing from said collected flux a magnetic field in said beam entrance region between corresponding ones of said field formers that provides convergence correction such that, in the absence of said field formers, said collected stray magnetic field flux would otherwise have formed a closed-loop path outside said neck portion of said cathode ray tube.

14. A television display apparatus, comprising:

a cathode ray tube for producing three in-line electron beams that travel through a neck of said cathode ray tube;

a deflection yoke including a horizontal deflection winding, a vertical deflection winding and a magnetically permeable core, forming an inner cavity that receives said neck portion of said cathode ray tube and having a beam entrance region and a beam exit region, for producing a main magnetic flux in said neck of said cathode ray tube that deflects said electron beams;

a plurality of magnetically permeable field formers disposed around said neck in the vicinity of said beam entrance region for collecting a stray magnetic field flux produced by said deflection yoke outside both said deflection yoke and said inner cavity to produce from said collected flux a magnetic field in said beam entrance region that corrects vertical coma convergence error; and a correction coil magnetically coupled to a given one of said field formers and responsive to a vertical rate parabolic current for producing a correction magnetic field in said beam entrance region that provides dynamic convergence in a horizontal direction.

* * * * *